US005379687A

United States Patent [19]

Moseley

[11] Patent Number: 5,379,687

[45] Date of Patent: Jan. 10, 1995

[54] BALE WIRE TIE APPARATUS AND METHOD

[75] Inventor: James D. Moseley, Montgomery, Ala.

[73] Assignee: Continental Eagle Corporation, Prattville, Ala.

[21] Appl. No.: 192,396

[22] Filed: Feb. 4, 1994

[51] Int. Cl.[6] ..... B65B 13/04

[52] U.S. Cl. ..... 100/3; 100/26

[58] Field of Search ..... 100/2, 3, 11, 25, 26, 100/29, 30

[56] References Cited

U.S. PATENT DOCUMENTS

| | | | |
|---|---|---|---|
| Re. 26,289 | 10/1967 | Neitzel et al. | 100/4 |
| 3,168,912 | 2/1965 | Marica | 140/101 |
| 3,220,337 | 11/1965 | Goland et al. | 100/26 X |
| 3,450,028 | 6/1969 | Goland et al. | 100/26 X |
| 3,475,879 | 11/1969 | Merkel et al. | 100/25 X |
| 3,477,363 | 11/1969 | Trumbo | 100/3 X |
| 3,834,297 | 9/1974 | Huson | 100/26 X |
| 3,916,778 | 11/1975 | Van Doorn et al. | 100/26 X |
| 4,391,186 | 7/1983 | Davis | 100/3 X |
| 4,573,403 | 3/1986 | Van Doorn et al. | 100/3 X |
| 4,611,534 | 9/1986 | Kudlicka et al. | 100/26 |
| 4,625,635 | 12/1986 | Lewis | 100/26 |
| 4,665,815 | 5/1987 | Fleissner | 100/26 X |

FOREIGN PATENT DOCUMENTS

| | | | |
|---|---|---|---|
| 273280 | 11/1965 | Australia | 100/26 |

*Primary Examiner*—Stephen F. Gerrity
*Attorney, Agent, or Firm*—Popham, Haik, Schnobrich & Kaufman, Ltd.

[57] ABSTRACT

A wire-tying apparatus is shown for automatically tying a plurality of wires around a bale of material while the bale is held in a compressed state in a baling chamber. A first part of the apparatus includes a hydraulic ram press, an upper platen and a lower platen. This part of the apparatus operates to compress material in a baling chamber. A second part of the apparatus includes a group of feed chutes mounted on one side of the baling chamber, and a group of guide chutes mounted on another side of the baling chamber. Drive wheels and gripping mechanisms are mounted on the feed chutes. The combination of the guide chutes and the feed chutes with drive wheels and gripping mechanisms provides a compact and simple arrangement for feeding and guiding wires around the compressed bale and interlocking opposite pre-looped ends of each wire to secure the bale.

8 Claims, 7 Drawing Sheets

FIG. 4
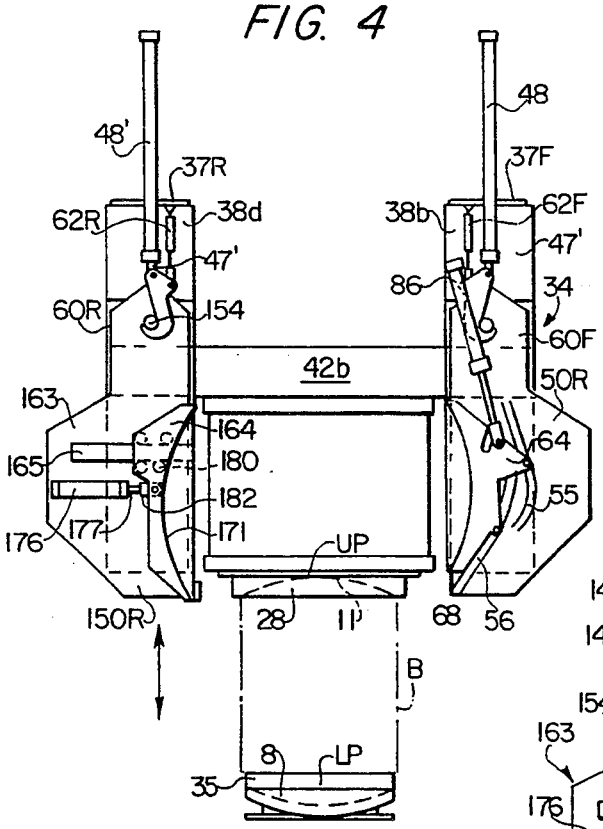
FIG. 5
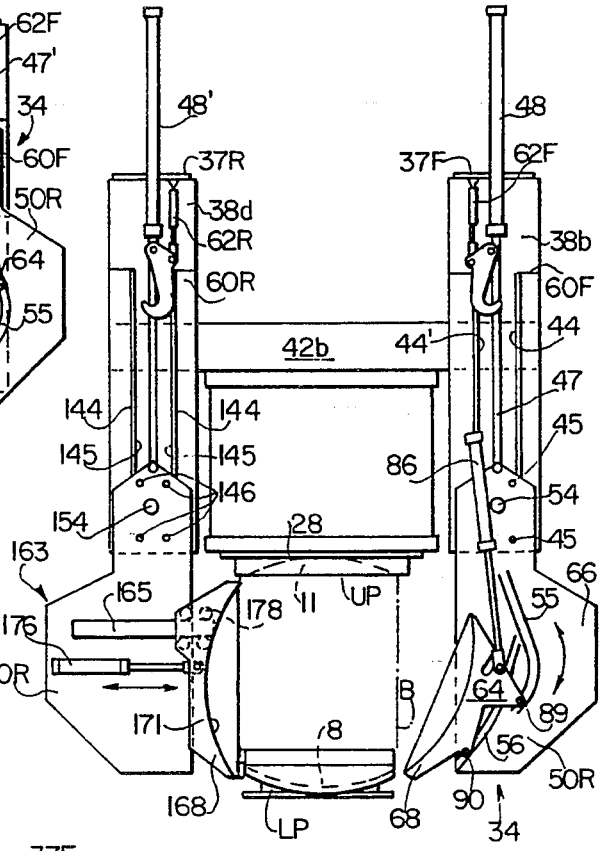
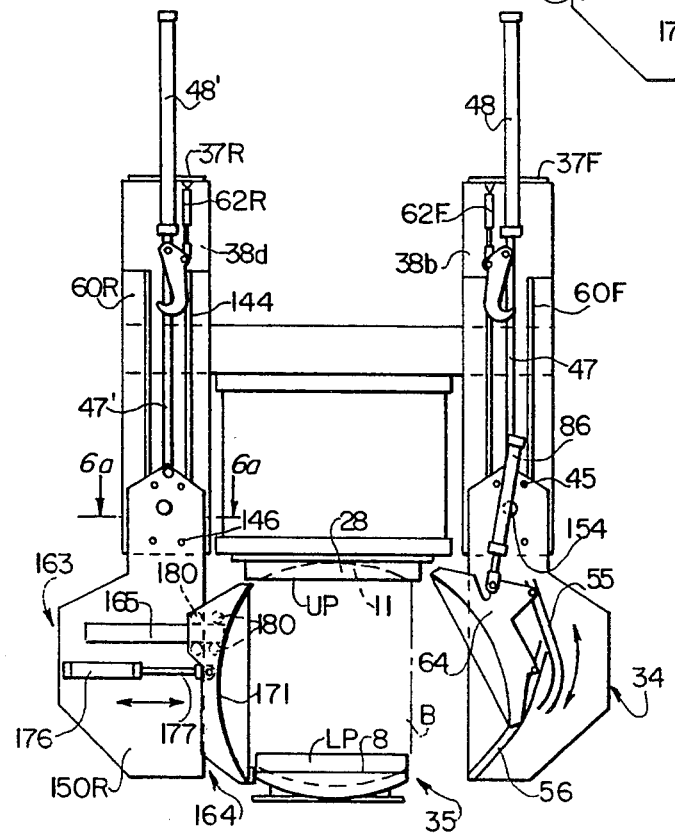
FIG. 6
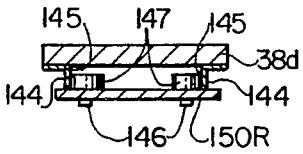
FIG. 6a

BALE WIRE TIE APPARATUS AND METHOD

BACKGROUND OF THE INVENTION

1. Field of the Invention

The present invention relates to an automatic wire-tying device for binding a bale of cotton with a plurality of encircling wires while the bale is in a compressed state.

2. Related Art

Bale forming devices of the general type with which the present invention is concerned are used with loose materials, such as cotton and other fibers or the like materials which are considerably fluffed when loose, but will form a comparatively solid bale when compressed such as in a gin press. The compressed components of a bale will fluff or expand when released from the press, and it becomes important, and is indeed essential, to provide ties or bands about the compressed material in order to retain the material in bale form.

Devices have been shown for automatically feeding wires around bale constituents while the bale constituents are in a compressed state in a press. However, with existing devices it is necessary for a worker to manually position the ends of the wires tying in order to secure them around the bale.

U.S. Pat. No. 3,220,337 to Goland et al. (1965), and U.S. Pat. No. Re. 26,289 to Neitzel et al. (1967) show devices for automatically directing bands around bales of material while the material is held compacted between the platens of a press. Both of these devices require complicated mechanisms for clipping the band while leaving overlapped portions, and then sealing the overlapped portions of the bands.

U.S. Pat. No. 3,477,363 to Trumbo (1969) shows a wire tying apparatus for securing bales of material, but requires the ends of the wires to be manually directed into position for interlocking.

Accordingly, objects and advantages of the present invention include:

(a) to provide apparatus for automatically binding a bale of material with a plurality of wires whereby the wires after loading in the machine are directed around the bale and are secured in place without any manual operations following placement of the wires in the apparatus;

(b) to provide a compact device for automatically binding a bale of material with power means for feeding a plurality of wires around the bale, wherein the power means are mounted directly on movable means for directing said plurality of wires around the bale and for interlocking opposite ends of each wire;

(c) to provide a compact and simple device for automatically binding a bale of material wherein the need for a separate mechanism to secure the binding material, after automatically feeding and directing the binding material around the bale is eliminated; and (d) to provide new and improved bale binding means and methods.

Still further objects and advantages will become apparent from a consideration of the ensuing description and drawings.

SUMMARY OF THE INVENTION

According to the present invention, the foregoing and other objects are attained by a wire tying device comprising separate front and rear assemblies which operate together to automatically tie a plurality of wires around a bale of material while the bale is held in a compressed state in a tying chamber. A follow block structure rests on a lower platen on a conventional ram head below the tying chamber; an upper fixed platen is positioned above the tying chamber; and a compressed, but untied bale is clamped in position between the follow block and the upper fixed platen by upward force of the ram head in a well known manner. A wire infeed assembly is mounted adjacent the front face of the untied bale and includes wire infeed chutes for feeding wires downwardly beneath the compressed bale into and through slots in the follow block from which the wires move upwardly into a rear wire guide assembly from which the leading end of the wire moves into grooves in an upper platen where the leading ends are connecting to the wire trailing ends. The wire infeed assembly can be pivoted about a vertical axis adjacent one side of the device for permitting loading of the wires at a location spaced from the bale area for safety reasons. A further object of the invention, therefore, is to allow the wire infeed assembly to be pivoted away from the baling chamber and the press. This feature enables an operator to load wires into the front assembly at a location spaced from the press, thus increasing safety of operation.

The wire infeed assembly on the front side of the bale and the rear wire guide assembly on the rear side of the bale each house a plurality of chutes that control and guide movement of the wires. Each chute is formed from a plurality of parallel, aligned plates rigidly connected together to form a plurality of wire chutes. The wire chutes of the infeed assembly are rigidly connected together to form an infeed chute subassembly and the chutes of the rear wire guide assembly are connected together to form a guide chute subassembly.

In accordance with another aspect of the invention, power means raise and lower front and rear pairs of head plates which support the infeed chute subassembly and guide chute subassembly, and separate power means move the guide chute subassembly and the infeed chute subassembly relative to their respective head plates. When the pairs of head plates are in their fully raised positions, they are located above the baling chamber. When the pairs of head plates are in their fully lowered positions, they are adjacent the baling chamber, and the feed chutes and guide chutes are in position to feed wires around a bale and to secure ends of the wires. Safety hooks secure each of the pairs of head plates in the raised position. Safety hook cylinders are activated to retract the safety hooks and to allow the power means to lower the pairs of head plates. The safety hooks ensure that the head plates will not be lowered accidentally, such as during a power outage.

In accordance with another aspect of the invention, the apparatus comprises track means on left and right main support plates of the front and rear assemblies for restricting motion of the pairs of head plates to vertical motion. The infeed chute head plates include cam track means engageable with the infeed chute subassembly for restricting motion of the infeed chute subassembly relative to the infeed chute head plates to simultaneous translation and concurrent rotation of the infeed chute subassembly. The guide chute head plates include track means for restricting motion of the guide chute subassembly relative to the guide chute head plates to horizontal motion.

A further aspect of the invention comprises wire feeding means for feeding the wires into encircling position around the compressed bale. The wire feeding means includes drive wheels fixed to a common drive wheel shaft mounted on the feed chute subassembly. A reversible hydraulic motor is also mounted on the feed chute subassembly and drives the common drive wheel shaft through a chain-and-sprocket or belt-and-pulley arrangement. The wire members are selectively pressed against each drive wheel by a pair of idler rollers which are commonly supported for simultaneous movement into contact with the drive wheels upon actuation of an idler roller control cylinder. The idler roller control cylinder is first activated during the wire loading sequence following manual positioning of the wires in individual wire chutes adjacent respective drive wheels. A compact and simple design is achieved by mounting the means for feeding the wires on the infeed subassembly. The drive wheels in the feed chute subassembly also serve to direct the wires upwardly around the rear face of the compressed bale and to secure opposite ends of each wire together to provide a closed wire loop around the bale. Both the feed chutes and the guide chutes include curved contact plates, which are positioned between the pair of parallel plates forming each feed chute or guide chute. These curved contact plates provide an inward radial force that is applied to the wires to cause them to be guided and directed around the bale.

A method of operating the apparatus includes a final sequence of steps beginning with the holding of each wire in place in its respective feed chute by activating a wire gripper cylinder mounted on the feed chute. The feed chute subassembly is then moved partially into the upper platen, thereby interlocking loops on opposite ends of the wire to provide closed wire loops encircling the bale. Finally the infeed chute subassembly and the guide chute subassembly are retracted a sufficient distance to clear the bale, the lower platen is moved downwardly to release the bale from compression so that it expands against the closed wire loops and the head plates (along with the subassemblies) are elevated to their start position and secured in position by the safety hooks.

BRIEF DESCRIPTION OF THE DRAWINGS

The invention is better understood by reading the following Detailed Description of the preferred embodiments with reference to the accompanying drawing figures, in which like reference numerals refer to like elements throughout, and in which:

FIG. 4 is a left side elevation view of the automatic wire-tying device (with some supporting and other structure not being shown for the sake of clarity) showing the wire infeed assembly and guide assembly and their associated subassemblies in their raised, starting position at time $T_0$ of the timing cycle of FIG. 11, prior to the initiation of a cycle of operation;

FIG. 5 is a side elevation view of the automatic wire-tying device similar to FIG. 4B but showing the feed chute and guide chute head plates at time $T_5$ in a subsequent position to that of FIG. 4B;

FIG. 6 is a side elevation view of the automatic wire-tying device showing the feed chute and guide chute head plates in a subsequent position to that of FIG. 5 in which the wire infeed subassembly has been pivoted forwardly to effect the locking of the ends of the wires together;

Figure 3:
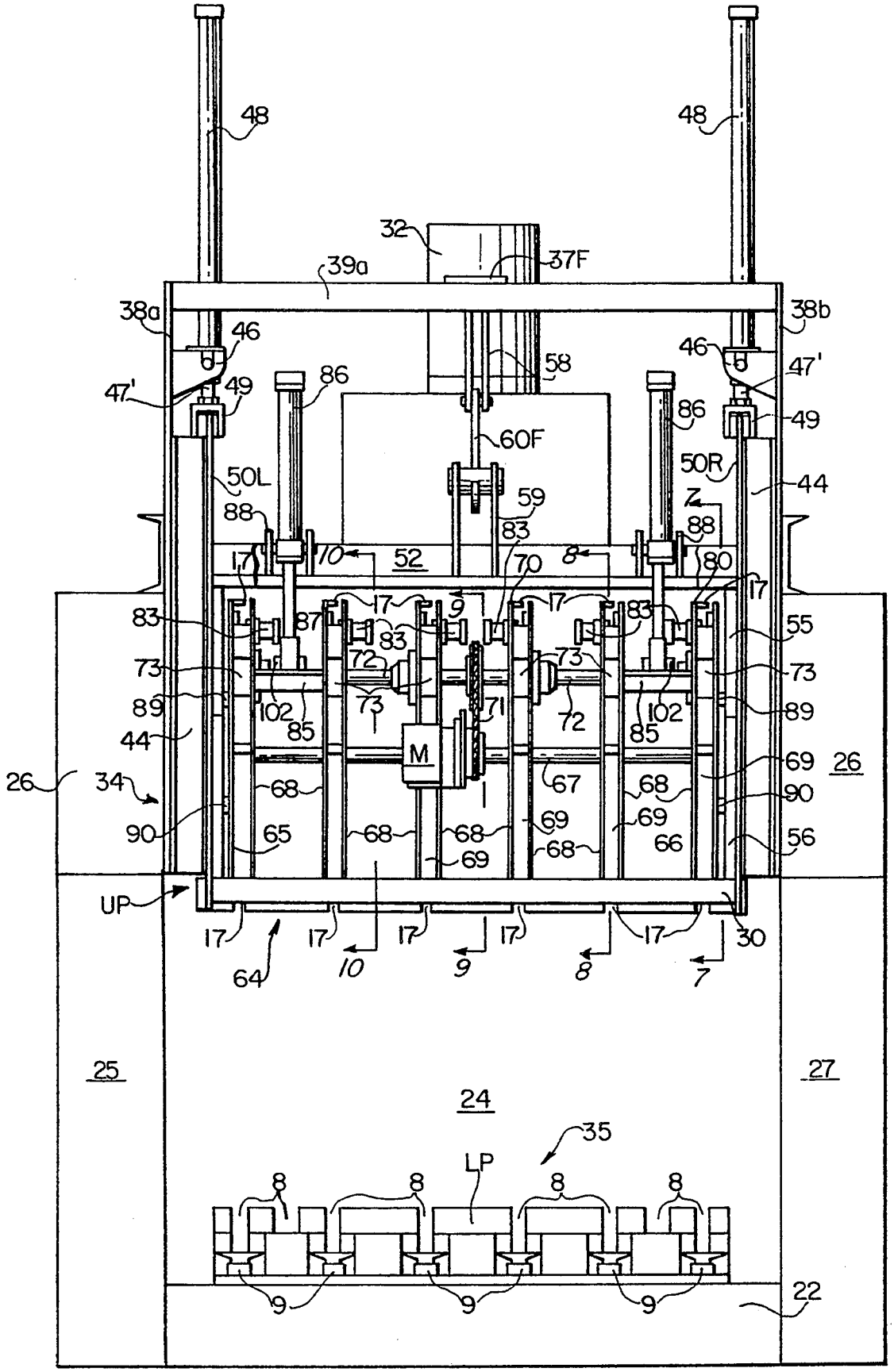
FIG. 3 is a front elevation view of the automatic wire-tying device.
Figure 8A:
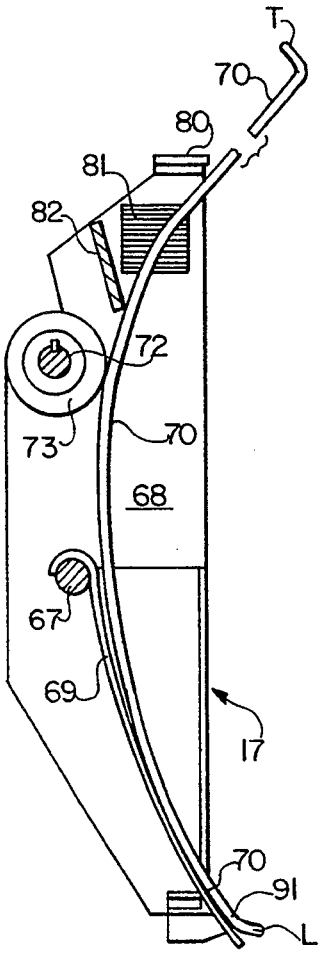
Figure 7:
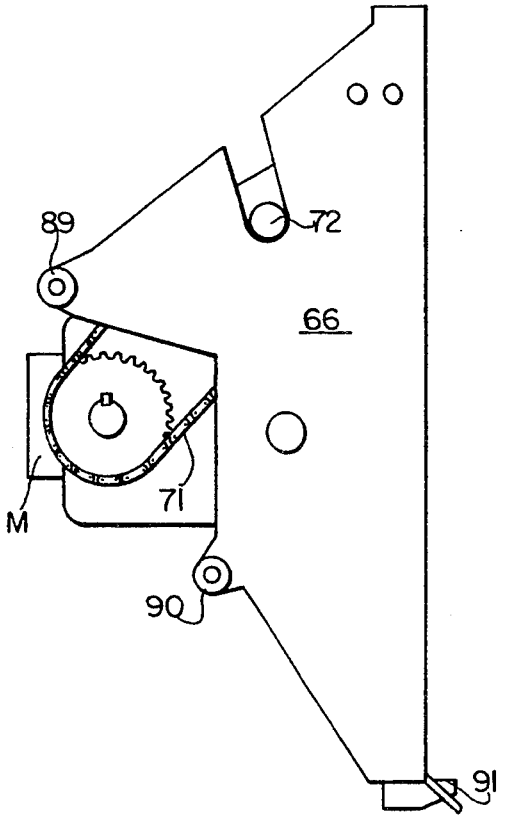
Figure 8:
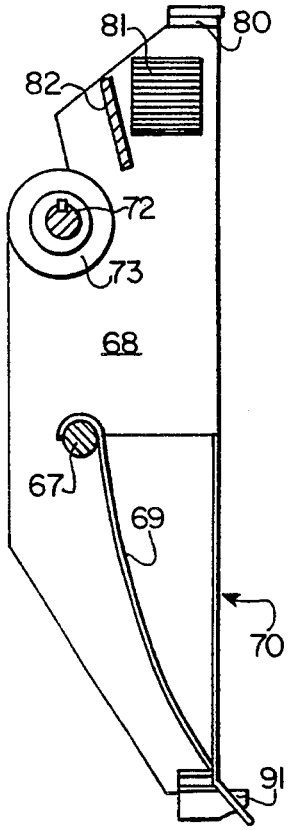
Figure 9:
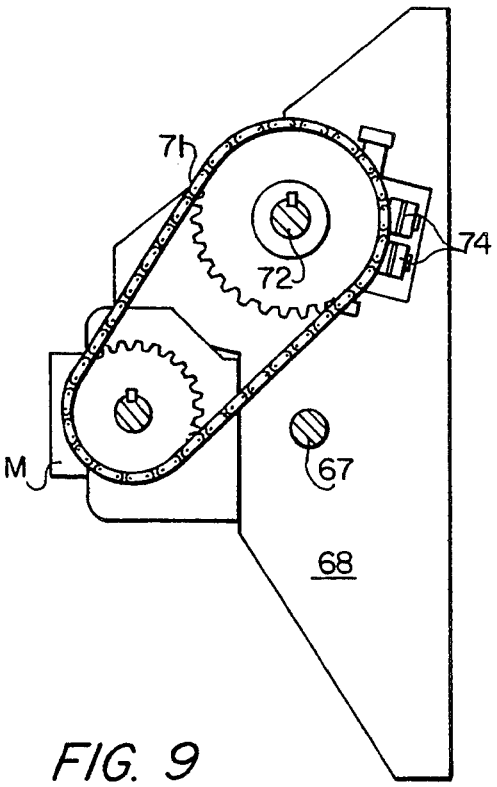
Figure 10:
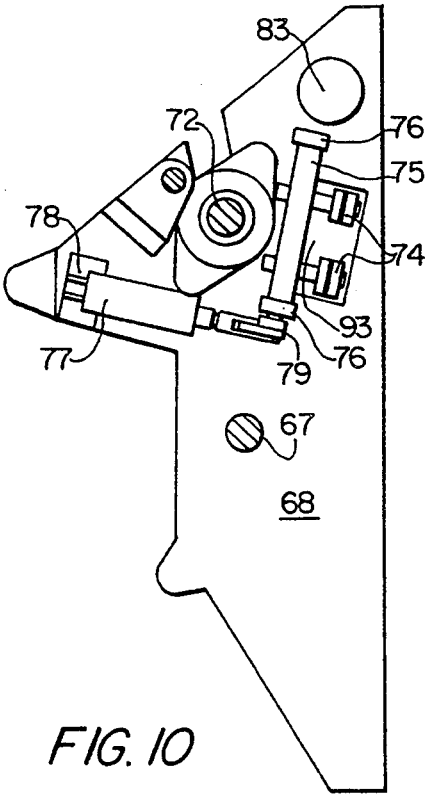
Figure 11:
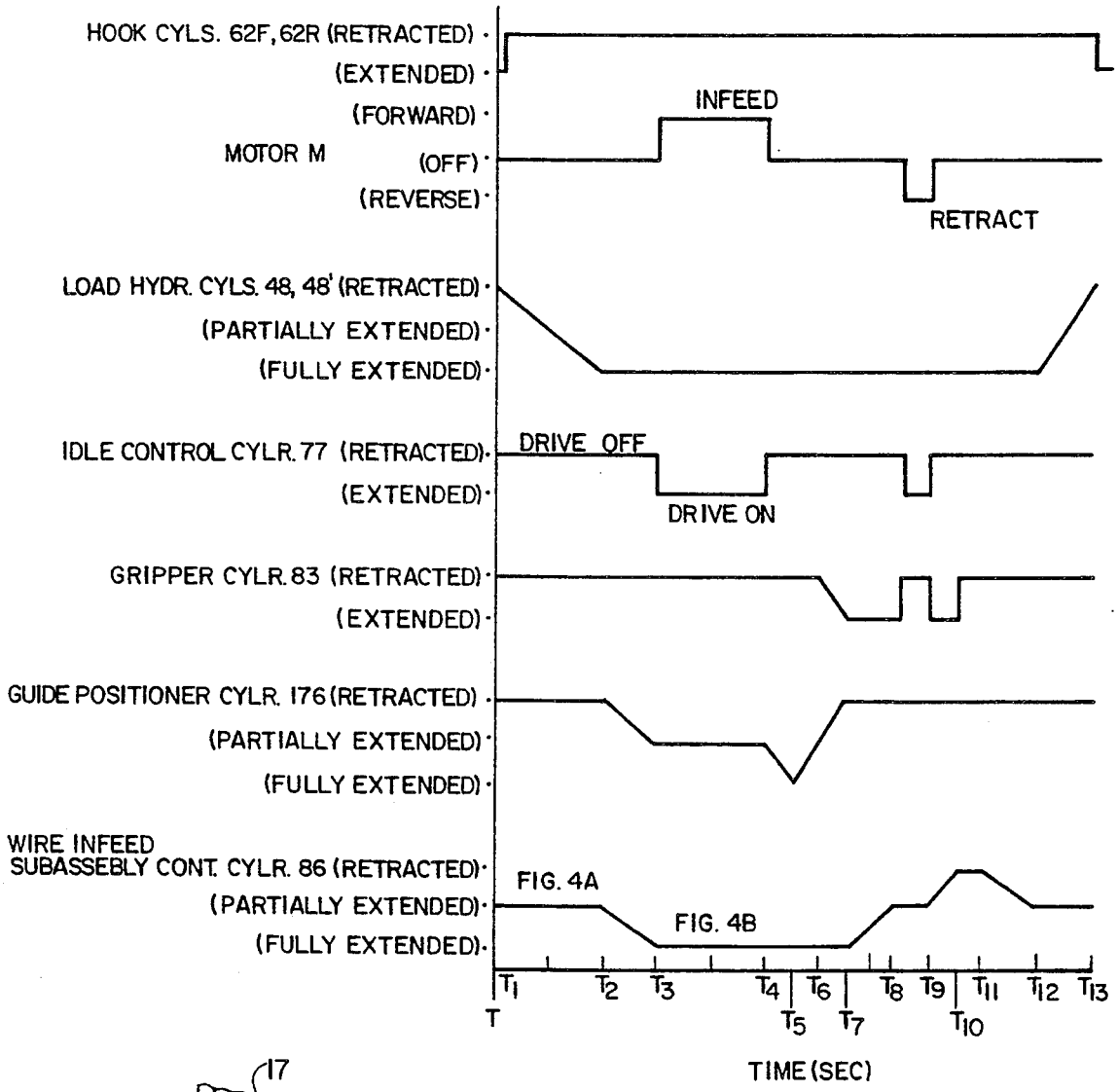
Figure 12:
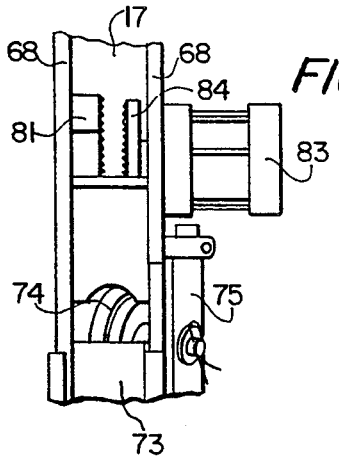
Figure 13:
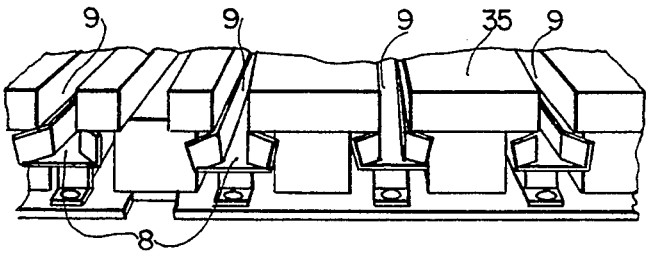

FIG. **6*a* is a section view taken along line 6*a*–6*a* of FIG. 6**;

FIG. 7 is a section view taken along line 7—7 of FIG. 3;

FIG. 8 is a section view of a wire infeed chute taken along line 8—8 of FIG. 3;

FIG. **8*a* is similar to FIG. 8** but illustrates a wire positioned in the wire infeed chute as the initial step in a cycle of operation;

FIG. 9 is a section view taken along line 9—9 of FIG. 3;

FIG. 10 is a section view taken along line 10—10 of FIG. 3;

FIG. 11 is a timing chart showing a cycle of operation of the preferred embodiment;

FIG. 12 is a front elevation view of the upper end of one of the wire infeed chutes; and FIG. 13 is a front perspective view of the lower platen follower block illustrating the wire guide chutes provided therein.

DETAILED DESCRIPTION OF THE PREFERRED EMBODIMENTS

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose. The terms right and left are used with respect to the device as viewed from the front in FIG. 3.

The main components of the assembly necessary to understand the invention are: (1) a wire infeed assembly 34 (FIG. 1A) having six vertical parallel wire infeed chutes 17 (FIG. 3) into which single individual tie wires 70 are initially positioned prior to the beginning of a binding cycle of operation; (2) a lower wire guide or follower block 35 (FIGS. 6 and 13) having six parallel horizontal bottom wire guide chutes 8 having curved bottom surfaces 9 (FIGS. 3, 13 and 14) which are aligned with chutes 17; (3) a rear wire guide assembly 163 (FIG. 6) having six vertical wire guide chutes 10 having a forwardly facing curved contact plate 171 (FIGS. 4 and 5) aligned with chutes 17 and S; and (4) an upper platen guide (UP) having six downwardly facing chutes 28 each of which has a curved downwardly facing upper surface 11 aligned with chutes 17, 8 and 10.

Figure 1A:
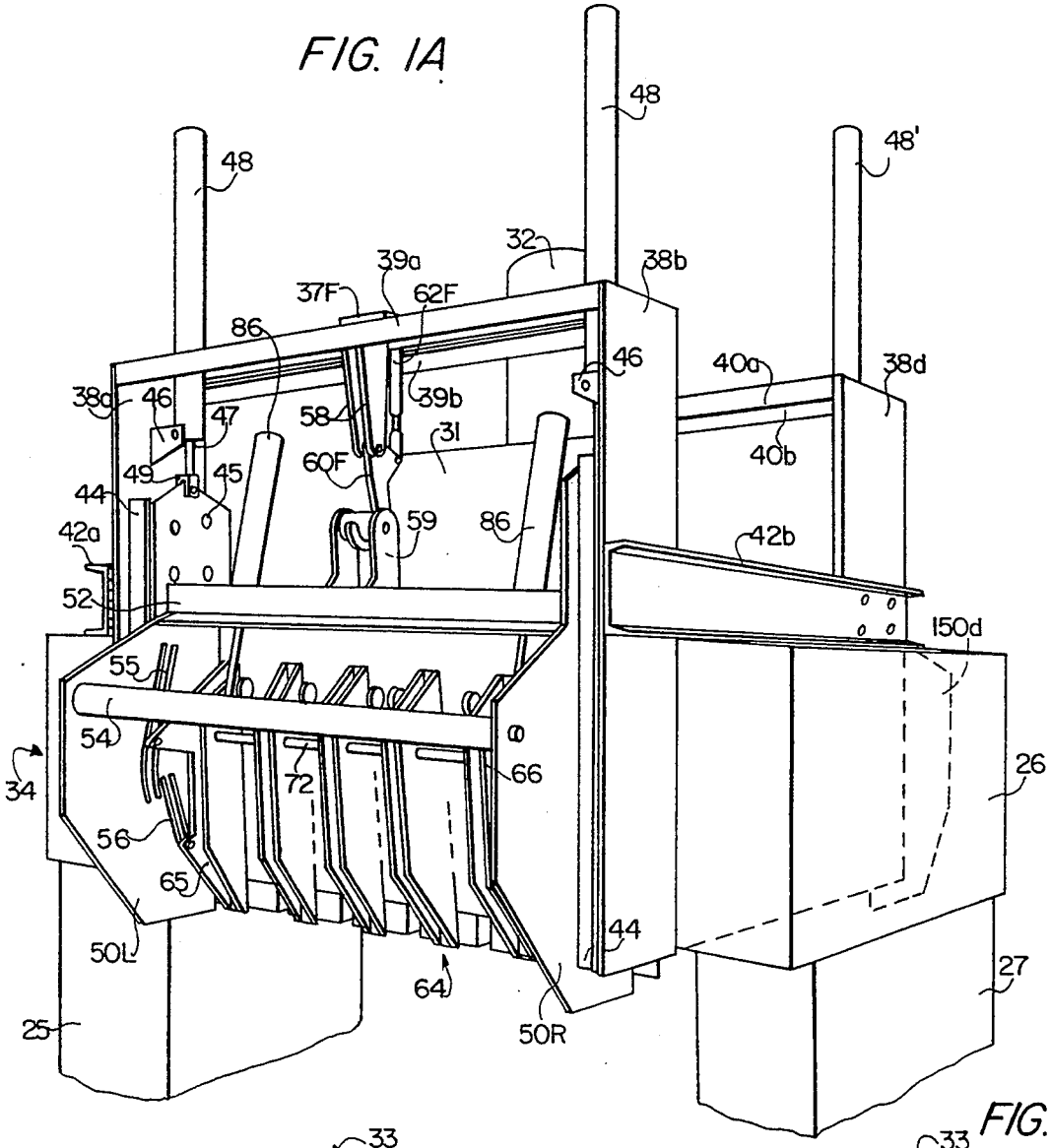
FIG. 1A is a front perspective view of the preferred embodiment (with some parts not being illustrated for the sake of clarity) of an automatic wire-tying device embodying the present invention.

Support for the components of the preferred embodiment is provided by a rigid metal support frame comprising vertical left column 25 (FIG. 1A), and vertical right column 27 which support a horizontal press beam 26 having a substantially square cross section as shown in FIG. 1A.

A control housing 31 and an electric motor/hydraulic pump 32 are mounted on press beam 26 as shown in FIG. 1A. Additional components of the main support frame include a horizontal left main support channel 42*a* (FIG. 2) and a horizontal right main support channel 42*b*. A vertically extending left front main support plate 38*a* is fixedly connected to the front end of horizontal left main support channel 42*a* and a vertically extending right front main support plate 38*b* is similarly fixedly attached to the front end of horizontal left main support channel 42*b*. A left rear main support plate 38*c* (FIG. 2) and a right rear main support plate 38*d* are similarly fixedly connected to the rear ends of horizontal main support channels 42*a* and 42*b*.

The upper ends of left front main support plate 38*a* and right front main support plate 38*b* are connected by transverse angle members 39*a* and 39*b* as shown in FIG. 1A. A front horizontal bracket support plate 37F is bolted to the upper surfaces of angle members 39*a* and 39*b* and provides support for downwardly extending hook support bracket plates 58 on the lower ends of which a safety hook 60F is pivotally mounted for movement by a front hook actuate air cylinder 62F into an extended position beneath an infeed assembly support bracket 59 as shown in FIG. 1A in which it prevents lowering of the infeed chute assembly 34 from the upper position illustrated in FIGS. 1A and 3.

The upper ends of left rear main support plate 38*c* and right rear main support plate 38*d* are connected by rear transverse angle members 40*a* and 40*b* (FIG. 1A). A rear horizontal bracket support plate 37R is bolted to the upper surfaces of angle members 40*a* and 40*b* and provides support for a rear safety hook 60R (FIG. 5) which is pivotally mounted for movement between an extended position beneath a rear spreader rod 154 of a rear guide chute assembly 163 for preventing lowering of the rear guide chute assembly 163 from the elevated position thereof illustrated in FIG. 2. A rear hook retract air cylinder 62R when retracted operates to retract rear hook 60R to a position clear of the guide chute head plate spreader rod 154 for permitting the rear guide chute assembly 163 to be lowered to the lower position illustrated in FIG. 5. Both air cylinders 62F and 62R are spring loaded to return to their extended positions shown in FIG. 4 in the event of power failure so as to automatically retain the infeed assembly 34 and guide chute assembly 163 in elevated positions.

Front load cylinder support brackets 46 are attached to the left front main support plate 38*a* and the right front main support plate 38*b* and provide support for front load cylinders 48 having rods 47 as shown in FIG. 1A. Clevis members 49 attached to the lower ends of rods 47 of front load cylinders 48 provide support for a left feed chute head plate 50L and a right feed chute head plate 50R both of which are supported from the clevis members 49. Head plates 50L and 50R are connected by a feed chute head plate spreader angle member 52 (FIG. 1A) and a cylindrical feed chute head plate spreader rod 54 to provide a rigid assembly that can be raised and lowered by front load cylinders 48. Spreader rod 54 is not illustrated in FIG. 3 for the sake of clarity.

Figure 2:
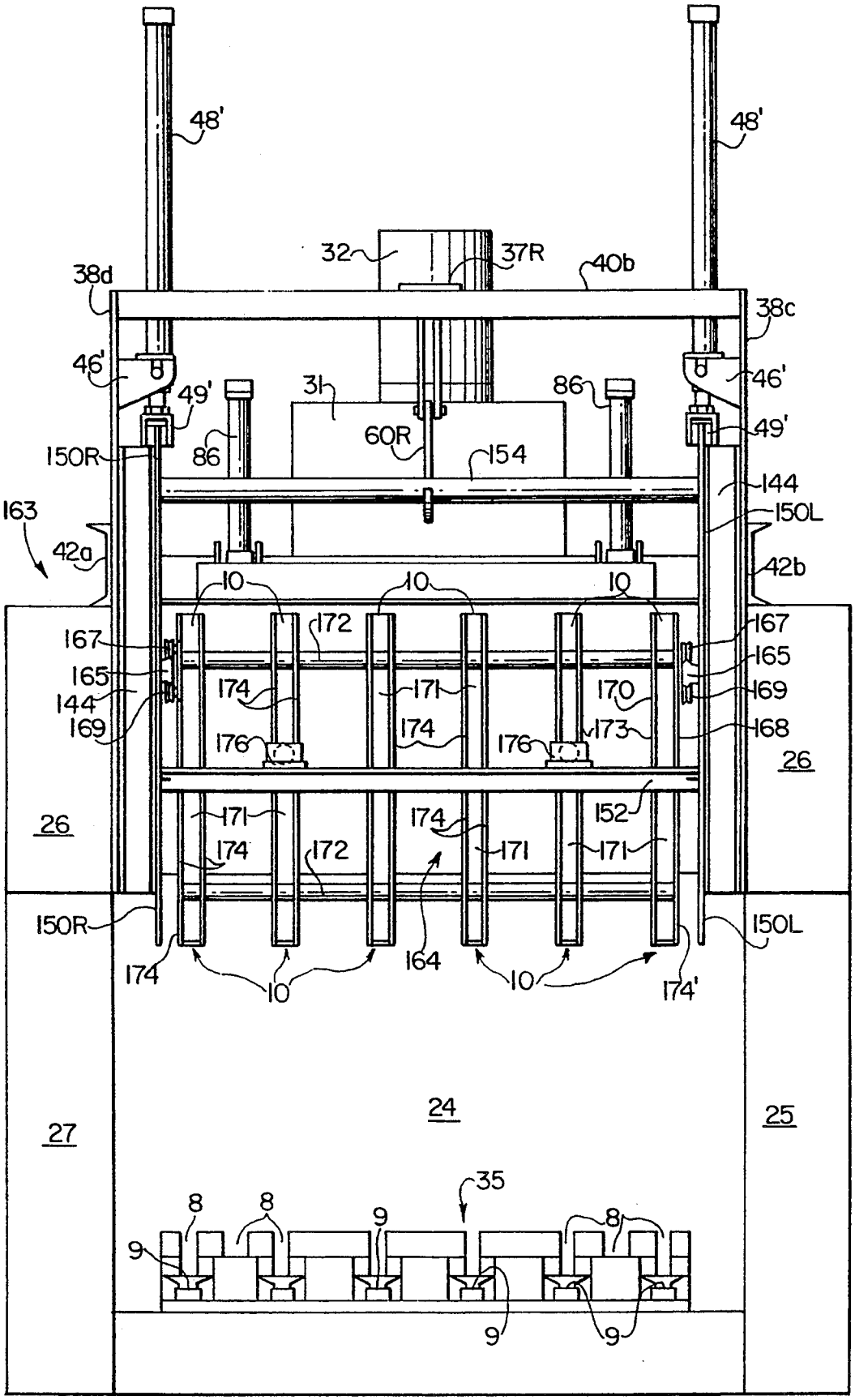
FIG. 2 is a rear elevation view of the automatic wire-tying device.

Rear load cylinders 48' are similarly supported on brackets 46' attached to the inner facing surfaces of the left rear main support plate 38*c* and the right rear main support plate 38*d* as best shown in FIG. 2. Similarly, clevis members 49' attached to the rods 47' of rear load cylinders 48' support guide chute head plates 150L and 150R of the vertically movable rear guide chute assembly 163 as shown in FIG. 2.

The rear guide chute assembly 163 includes a pair of spreader angle members 152 and a rear guide chute assembly spreader rod 154 which provide a fixed interconnection between the guide chute head plates 150L and 150R so that the entire rear guide chute assembly 163 is capable of vertical movement by the operation of cylinders 48'. Previously mentioned spreader rod 154 (FIG. 2) is also fixedly connected between the guide chute head plates 150L and 150R as shown in FIG. 2 for selective engagement with rear safety hook 60R when in its elevated position of FIG. 2.

A conventional press forming no part of this invention is used to compress resilient fiber material such as cotton placed in baling chamber 24 so as to form a bale B. Bale B is positioned between an upper platen UP and a follow block of a lower platen LP mounted on the upper end of a ram which presses upwardly against bale B to maintain the bale in compression against the upper fixed platen UP. Pre-looped wire ties 70 of the type shown in U.S. Pat. No. 3,168,912 are manipulated to encircle bale B and maintain it in compressed condition upon release of pressure on the bale from lower platen LP in a manner which will be discussed hereinafter. For a detailed description of the method for tying the opposite, pre-looped ends of wires 29 together, see FIGS. 18–30 and Col. 5, line 40 through Col. 6, line 37 of Marica U.S. Pat. No. 3,168,912, incorporated herein by reference.

The inner surface of the rear main support plate 38*d* is provided with parallel angle track members 144 (FIG. 5) which have facing surfaces 145 which are engaged by four follower rollers 147 mounted on studs 146 extending outwardly from the right surface of the guide chute head plate 150R as shown in FIG. 6*a* so as to permit guide chute head plate 150R to move upwardly or downwardly while being restrained from any frontward or rearward movement. Similarly, left rear main support plate 38*d* is provided with guide chute head plate guide tracks 144 having inwardly facing surfaces 145 engageable with rollers 147 mounted on studs 146 in exactly the same manner as discussed in the preceding sentence with respect to plate 38*d* and head plate 150R. The entire rear guide assembly 163 is consequently movable in a vertical direction.

The left and right front main support plates 38*a* and 38*b* are similarly provided with feed chute head plate-guide tracks 44 which are identical to guide tracks 144 and the left feed chute head plate 50L and the right feed chute head plate 50R are likewise provided with studs 45 on which rollers identical to rollers 147 are mounted for engagement with tracks 44. Thus, the wire infeed assembly 34 is also guided for vertical movement by tracks 44 and rollers on guide plates 50L and 5OR.

The rear guide chute subassembly 164 is supported for horizontal movement between the left rear guide chute head plate 150L and the right rear guide chute head plate 150R as shown in FIG. 2 by horizontal support rails 165 (FIGS. 2 and 4) extending inwardly from the inner surfaces of head plates 150L and 150R as shown in FIG. 2. Rails 165 engaged by upper idler rollers 167 and lower idler rollers 169 which have V-shaped peripheries and are mounted on stud shafts 180 extending in cantilever manner from the leftmost and rightmost side plates 174' of the guide chute subassembly 164 for engagement with the upper and lower portions of an inner flange provided on rails 165 as shown in FIG. 2. The guide chute subassembly 164 is consequently capable of horizontal reciprocation relative to rear guide chute head plates 150R and 150L between an inward position illustrated in FIG. 6 and an outward position illustrated in FIG. 4. Such movement of the guide chute subassembly 164 is effected by a pair of horizontal guide positioner cylinders 176 which have rods 177 connected to a bracket 182 (FIG. 4) and cylinders attached to the rear guide chute assembly spreader angle member 152 which is fixedly connected at its outer ends to the guide chute head plates 150L and 150R. Six individual rear wire guide chutes 10 are provided in the rear guide chute subassembly 164 with each individual wire guide chute 10 comprising an internal curved contact plate 171 and a pair of side plates 174 which are welded together.

The details of the wire infeed assembly 34 will be discussed with initial reference being made to FIGS. 1A and 3, it being first noted that infeed subassembly 64 consists of the structure movably supported between the left feed chute head plate 50L and the right feed chute head plate 50R. The head plates 50L and 50R are connected by the cylindrical feed chute head plate spreader rod 54 (FIG. 1A) and the feed chute head plate spreader angle member 52 to provide a rigid frame structure which is movable vertically by operation of front load cylinders 48.

The inwardly facing surfaces of feed chute head plates 50L and 50R are both provided with an upper cam track 55 and a lower cam track 56 as shown in FIGS. 1A and 4. Each of the aforementioned cam tracks is formed by welding two parallel plates to the inner surface of the feed chute head plate with which it is associated. The wire infeed subassembly 64 is movable relative to the rigid frame structure defined by members 50L, 50R, 52 and 54 and comprises a left end plate 65 and a right end plate 66 and the structure supported by and between such end plates as illustrated in FIG. 3. A transverse spacer rod 67 extends between and is welded to the end plates 65 and 66. Additionally, ten wire guide chute side plates 68 are welded at spaced intervals to the transverse spacer rod 67 and to six internal curved wire deflector plates 69 (FIG. 8A) to define six wire infeed chutes 17 as best illustrated in FIGS. 3 and 8. It should be understood that the invention is not limited to the precise number of wire infeed chutes disclosed in that a different number of chutes could be employed if desired.

Subassembly control cylinders 86 are supported by feed chute head plate spreader angle member 52 and have their rods pivotally connected to brackets 102 mounted on bracket support plates 85 (FIG. 3) on the wire infeed subassembly 64. Subassembly control cylinders 86 operate for moving subassembly 64 downwardly so that cam tracks 55 and 56 cause subassembly 64 to move to the various positions and orientations shown in FIGS. 4, 4A, 4B, 5 and 6.

The infeed subassembly 64 additionally includes a reversible hydraulic motor and associated control valve assembly M which is mounted on one of the centrally located wire infeed chutes 17 as shown in FIG. 3 and drives a chain 71 which in turn drives a drive roller drive shaft 72 extending transversely through each of wire infeed chutes 17. A hard rubber or the like drive wheel 73 drivingly keyed to drive shaft 72 is provided internally on the interior of each wire infeed chute 17 as shown in FIG. 3.

Two idler friction rollers 74 are supported on transverse rods extending from a pivot shaft 75 carried in brackets 76 secured to the outer surface of one of the internal wire infeed chute side plates 68 of each wire infeed chute 17 (as shown in FIG. 10). An idler control cylinder 77 has its head end pivotally attached to a bracket 78 secured to the outer surface of the side plate 68 and has its rod end pivotally connected to an eccentric arm 79 fixedly secured to the lower end of pivot shaft 75. Extension of cylinder 77 consequently swings the rollers 74 from their retracted position shown in FIG. 10 through an opening 93 (FIG. 10) in side plate 68 toward the drive wheel 73 to force any wire that is positioned adjacent the drive wheel against the drive wheel so that the rotation of the drive wheel will effect movement of the wire in either a forward or reverse direction in accordance with the direction that motor M is being driven.

A guide tab 80 is provided at the top of each wire infeed chute 17 and extends in a cantilever manner from one of the side plates 68 but is not connected to the other side plate so that there is a clearance between the outer end of the guide tab and the opposite side plate. A gripper pad 81 is provided on the interior of one of the side plates 68 in each wire infeed chute 17 and a wire infeed guide plate 82 is positioned forwardly of gripper pad 81 and is welded between the two side plates 68 of each wire infeed chute 17 as best shown in FIG. 8. A clamp cylinder 83 (FIG. 12) is mounted externally of the plate 68 opposite the plate 68 to which the anvil is attached and has its rod extending through the plate on which it is mounted. The rod of cylinder 83 is in alignment with gripper pad 81 and a clamp plate 84 is attached to the outer end of the rod so that upon actuation of cylinder 83 the clamp plate 84 will be forcefully moved toward the gripper pad 81. The facing surfaces of gripper pad 81 and clamp plate 84 are roughened to increase their friction capability since the purpose of these items is to clamp a tie wire 70 to prevent feed movement thereof during a portion of each cycle of operation of the device. The lower end of each wire infeed chute 17 is provided with a vertical fin 91 as shown in FIG. 8 for aiding in the alignment of wire ends during the attachment procedure in a manner to be discussed.

Two bracket support plates 85 are welded between two of the wire infeed chutes 17 as shown in FIG. 3 and are pivotally connected to the end of rod 87 of one of two subassembly control cylinders 86 pivotally mounted on brackets 88 fixed to the feed chute head plate angle member 52.

A cam follower roller 89 mounted on a stud externally of left end plate 65 is received in the upper cam track 55 and a lower cam follower roller 90 is likewise received in the lower cam track 56 of the left feed chute head plate 50L. Similarly, an upper cam follower roller 89 and a lower cam follower roller 90 are mounted on the outer surface of right end plate 66 and are received in the corresponding cam tracks 55 and 56 provided on the right feed chute head plate 50R. It will consequently be seen that actuation of the subassembly control cylinders 86 will create movement of the entire subassembly both in a vertical direction and a turning direction with lowering movement of the subassembly causing the lower end of the guide chutes to move inwardly as shown by comparison of FIGS. 4B and 5.

A cycle of operation will be discussed with reference to FIG. 11. The alternative embodiment operates in the same manner as the first embodiment in all other respects. At time $T_0$ there are parts in the position illustrated in FIG. 1A, 2, 3, 4, 10 and 12. Prior to $T_0$, wire tie members 70 of the type shown in U.S. Pat. No. 3,168,912 having a leading end 70L and a trailing end 70T are manually inserted downwardly (leading end 70L first) into each wire infeed chute 17 and manually moved downwardly into the position shown in FIG. 8A. The operator can manually detect when the wire loop on end 70L snaps over vertical fin 91 and terminate insertion of the wire at that time. All of the tie wires are consequently evenly positioned in parallel relationship in the wire infeed chutes 17 and await the beginning of the power portion of the cycle at $T_1$.

At time $T_0$, the apparatus is in its deactivated condition and hook actuate cylinders 62F and 62R along with hooks 60F and 60R are in their extended positions (FIGS. 1A, 2, 3 and 4) so as to preclude lowering movement of the infeed assembly 34 and/or the rear guide assembly 163. The bale B is in clamped compressed condition between upper platen UP and wire guide or follower block 35 and the parts are consequently in the positions illustrated in FIG. 4. The motor M is deactivated, load cylinders 48 and 48' are in their retracted condition assumed at the terminal portion of the preceding cycle of operation, the idler control cylinders 77 are in their retracted condition, the gripper cylinders 83 are in their retracted condition, the guide positioning cylinders 176 are in their retracted position of FIG. 4 and the feed cylinders 86 are in their intermediate position so that the infeed subassembly 64 is in its intermediate position relative to plates 50R and 50L as shown in FIG. 4.

A cycle of operation actually begins at time $T_1$ at which time the hook cylinders 62F and 62R are retracted by providing compressed air to such cylinders in a well known manner. Simultaneously, with the hook cylinders reaching their retracted position, the hooks 60F and 60R are moved to their retracted position and load cylinders 48 and 48' are activated so that they begin to extend and lower the infeed assembly 34 and the rear guide assembly 163 to their lower positions shown in FIG. 4A, the lowering operation being completed in approximately two seconds at time $T_2$.

However, it should be understood that the infeed subassembly 64 remains at the intermediate position relative to plates 50R and 50L shown in FIG. 4 until $T_2$ at which time subassembly control cylinders 86 are actuated to move toward their extended position. Activation of subassembly control cylinders 86 to their fully extended position causes wire infeed subassembly 64 to reach its lowermost position shown in FIG. 5 at $T_3$.

Figure 4A:
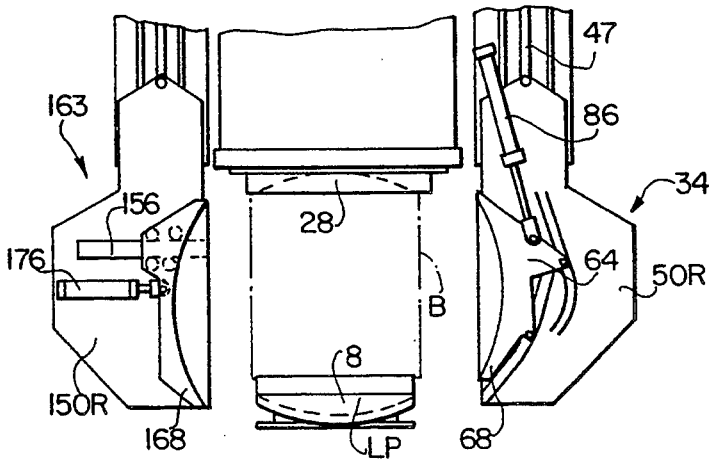
FIG. 4A is a left side elevation similar to FIG. 4 but showing the components in a lowered position at time $T_2$ of the cycle of operation.
Figure 4B:
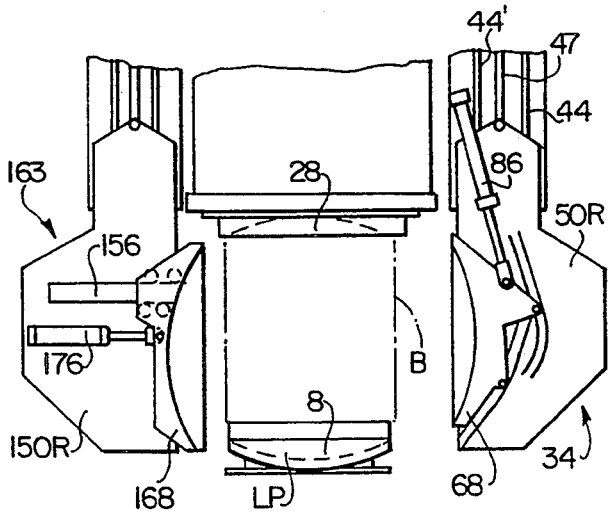
FIG. 4B is a left side elevation similar to FIG. 4A but showing the parts in subsequent position at time $T_3$ of the cycle of operation.

Guide positioning cylinders 176 are also activated at $T_2$ so as to move to a partially extended position so that guide subassembly 164 moves forwardly approximately four inches to an intermediate position shown in FIG. 4B which it reaches 164 is consequently ready to receive the leading ends 70L of wire tie members 70.

At T3 motor M is activated in a forward wire infeed direction to cause drive wheel 73 to rotate in a clockwise direction as viewed in FIG. 8A and idler control cylinders 77 are activated to move idler friction rollers 74 to their operative positions in which they engage the tie members 70 and move them to the left as viewed in FIG. 8A into forceful contact with their associated drive wheel 73 so that the leading end 70L of each wire tie member 70 moves downwardly, clears the infeed subassembly 64, moves into and through its horizontal bottom wire guide chute 8 in lower platen LP, moves into and upwardly through its rear wire guide chute 10 of rear guide chute subassembly 164 and then exits upwardly therefrom and moves into its respective upper wire guide chute 28 in upper platen UP in which each tie member 70 is engaged by a conventional "Winn" type wire lock or equivalent for preventing reverse movement of the leading end 70L of the member 70, as described in detail in U.S. Pat. No. 3,477,363, which is herein incorporated by reference. The leading end 70L is consequently restrained from movement out of the upper wire guide chute 28.

Operation of drive motor M is terminated at $T_4$ so that each wire stops movement with its leading end being in its upper wire guide chute 28 of the upper platen UP and its trailing end immediately above the gripper pad 81 (FIG. 8A). Idler rollers 74 are retracted at $T_4$ by deactivation of air cylinders 77 to return the cylinders 77 and rollers 74 to their retracted FIG. 10 positions.

At $T_4$ guide positioner cylinders 176 are again activated to move to the end of their stroke to move the guide subassembly 164 two inches forwardly to its forward most position shown in FIG. 6, which movement takes approximately one-half second and is completed at $T_5$. Such forward movement of subassembly 164 causes the trailing end T of each tie member 70 to be moved into the rear end of its upper wire guide chute 28. When subassembly 164 reaches it forwardmost position of FIG. 6, positioner cylinders 176 are immediately activated to begin contraction and movement of the subassembly toward its rearmost position which it reaches at $T_7$ at which time it is clear of tie 70 and its operation in the cycle is completed.

At $T_6$ gripper cylinders 83 are activated to cause clamp plate 84 to move toward gripper pad 81 to clamp tie member 70 against gripper pad no later than time $T_7$ so that tie member 70 is fixedly held against any relative movement with respect to infeed subassembly 64.

At $T_7$ wire infeed subassembly control cylinders 86 are again activated to begin retracting movement toward their intermediate position shown in FIG. 4B which position is reached at $T_8$. Since the wire gripper means 81, 84 is activated during such movement, there is a reduction in slack in the tie member 70 extending through the guide block 35 of lower platen LP and the rear guide subassembly 164.

At $T_8$ gripper cylinder 83 is moved to its retracted position to release the gripping action of gripper pad 81 and clamp plate 84 so that the tie 70 is free to be fed by operation of motor M, drive wheel 73 and idler rollers 74 when activated. Motor M is activated in a reverse direction at $T_8$ along with concurrent activation of idler control cylinder 77 to cause the trailing portion of wire tie 70T to be fed in a reverse direction causing the trailing end 70T and fixedly held leading end 70L of the wire tie 70 to loosely engage in a manner analogous to that shown in Marica U.S. Pat. No. 3,168,912 such as in FIG. 22 thereof for example.

At $T_9$ motor M and idler control cylinders 77 are deactivated and gripper cylinder 83 is activated so that tie member 70 is once again clamped and fixedly held between gripper pad 81 and clamp plate 84. Moreover, the wire infeed control cylinders 86 are activated to rotate infeed subassembly 64 toward the position shown in FIG. 6 which is reached at $T_{10}$; thus, the leading end 70L and trailing end 70T loosely interlock in the manner shown in FIG. 26 of Marica U.S. Pat. No. 3,168,912 as a consequence of the tension applied to the trailing portion of wire tie 70 by such movement while the leading end 70L is held in fixed position in its chute 28.

Gripper cylinder 83 moves to its retracted position at $T_{10}$.

At $T_{11}$ wire infeed subassembly control cylinders 86 are activated to move toward their intermediate position of FIG. 4A which is reached at $T_{12}$.

Load cylinders 48 and 48' are activated at $T_{12}$ to lift the entire assembly from the FIG. 4A position to the FIG. 4 position lower.

Lower platen LP is subsequently lowered to relieve pressure on the bale which then expands against the wire ties 70 so that their ends 70L and 70T are pulled in opposite directions and fully interlock in the manner shown for example in FIG. 30 of Marica U.S. Pat. No. 3,168,912 to complete the cycle. It should be appreciated that the apparatus can be operated by manual actuation or automatically by the use of conventional control components, timers, position sensors and the like.

Figure 1B:
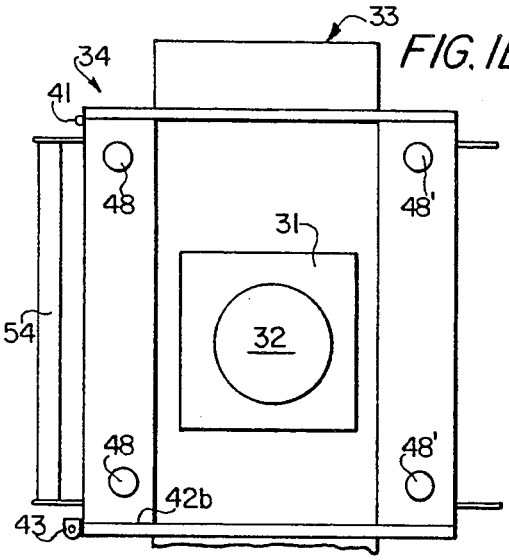
FIG. 1B is a top plan view of an alternative embodiment of the automatic wire-tying device with the front wire infeed assembly in a closed and latched position.
Figure 1C:
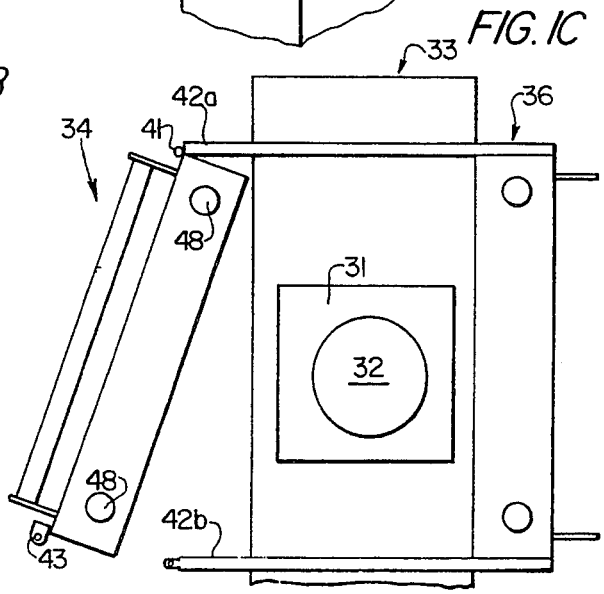
FIG. 1C is a top plan view of the alternative embodiment of the automatic wire-tying device with the front wire infeed assembly pivoted away from the hydraulic ram press in a wire loading position.

FIG. 1B and 1C illustrate an alternative embodiment in which the wire infeed assembly 34 is hingedly supported at 41 and latched by means 43 so as to be movable outwardly as shown in FIG. 1C to a loading position spaced from the bale area for safety reasons.

It should be understood that the subject invention is not limited to the disclosed embodiment since numerous obvious modifications will undoubtedly occur to those of skill in the art; therefore, the spirit and scope of the invention is limited solely by the following claims.

LIST OF DESIGNATORS

8—Horizontal bottom wire guide chutes.
9—Bottom of chute 8
10—Wire guide chutes
11—Downwardly facing upper surface
17—Wire infeed chutes
20—First assembly
24—Baling chamber
25—Left vertical column
26—Press beam
27—Right vertical column
28—Upper wire guide chutes
30—Upper platen
31—Control housing
32—Electric motor hydraulic pump
34—Wire infeed assembly
35—Lower wire guide or follower block
36—Rear assembly
37F—Front horizontal bracket support plate
37R—Rear horizontal bracket support plate
**38*a***—Left front main support plate
**38*b***—Right front main support plate
**38*c***—Left rear main support plate
**38*d***—Right rear main support plate
**39*a***—Transverse angle members
**39*b***—Transverse angle members
**40*a***—Rear transverse angle members
**40*b***—Rear transverse angle members
41—Hinge
**42*a***—Left main support channel
**42*b***—Right main support channel
43—Latch
44—Feed chute head plate guide track
45—Studs
46—Front load cylinder bracket
46'—Rear load cylinder bracket
47—Front rods
47'—Rear rods
48—Front load cylinders
48'—Rear load cylinders
49—Front clevis member
49'—Rear clevis member
50L—Left feed chute head plate
50R—Right feed chute head plate
52—Feed chute head plate spreader angle member
54—Cylindrical feed chute head plate spreader rod
55—Upper cam track
56—Lower cam track
58—Safety hook bracket
59—Infeed assembly support bracket
60F—Front safety hook
60R—Rear safety hook
62F—Front hook actuate cylinder
62R—Rear hook actuate cylinder
64—Infeed chute sub-assembly
65—Left end plate
66—Right end plate
67—Transverse spacer rod
68—Internal wire guide chute side plates
69—Curved deflector plates
70L—Tie member leading end
70T—Tie member trailing end
71—Chain
72—Drive wheel drive shaft
73—Drive wheel
74—Idler friction roller
75—Pivot shaft
76—Brackets
77—Idler control cylinder
78—Bracket
79—Eccentric arm
80—Guide tab
81—Gripper pad
82—Wire infeed guide plate
83—Clamp cylinder
84—Clamp plate
85—Bracket support plates
86—Infeed subassembly control cylinders
87—Rod
88—Bracket
89—Cam follower roller
90—Lower cam follower roller
91—Vertical fin
93—Opening
102—Control cylinder brackets
104—Idler roller shaft
106—Idler roller
108—Gripper cylinder
110—Anvil pad
140—Rear assembly cross member
144—Guide chute head plate guide track
145—Inner surfaces
146—Studs
147—Rollers
150L—Left rear guide chute head plate
150R—Right rear guide chute head plate
152—Guide chute head plate spreader angle
154—Guide chute head plate spreader rod 156—Guide chute sub-assembly guide tracks
163—Rear guide chute assembly
164—Guide chute sub-assembly
165—Horizontal support rails
167—Upper idler roller
168—Guide chute end plate
169—Lower idler roller
170—Guide chute plate
171—Internal curved guide chute contact plate
172—Guide chute sub-assembly spreader rod
173—Guide chutes
174—Side plates
174'—Leftmost and Rightmost side plates
176—Guide positioner cylinders
177—Cylinder rods
178—Guide chute rollers
180—Stud shaft
UP—Upper platen
LP—Lower platen
B—Bale
M—Hydraulic motor and control valve assembly

What is claimed is:

1. A wire binding applying device for binding a bale of material with a plurality of wires while the bale is in a compressed state, said binding applying device comprising:

(a) a fixedly positioned rigid support frame structure having a front side, a rear side, a left side and a right side, and further including a left front main support plate, a right front main support plate and spacing means for rigidly connecting the left front main support plate to the right front main support plate in parallel, facing relationship, a left rear main support plate, a right rear main support plate and rear main spacing means for rigidly connecting said left rear main support plate and said right rear main support plate in parallel facing relationship;

(b) a front wire infeed assembly positioned between said left and right front main support plates and a rear wireguide assembly positioned between said left and right rear main support plates, said front wire infeed assembly and said rear wire guide assembly being mounted for vertical movement on said support frame structure and each having a left side, a right side, a top and a bottom;

(c) said front wire infeed assembly including left and right feed chute head plates located between said left and right front main support plates and feed chute head plate spacing means for rigidly connecting said feed chute head plates in parallel aligned, relationship and an infeed subassembly supported by said feed chute head plates and including a plurality of parallel chute side plates defining individual wire guide infeed chutes each including two adjacent chute plates and an internal wire guide deflector plate connecting the two adjacent chute plates in a rigid assembly;

(d) said rear wire guide assembly including a pair of guide chute head plates located between said left and right rear main support plates and guide chute spacing means for rigidly connecting said guide chute head plates in parallel, aligned relationship and a rear wire guide chute subassembly mounted for front to rear movement between said guide chute head plates, and including a plurality of parallel individual rear wire guide chutes, each rear wire guide chute including a pair of aligned plates rigidly connected in spaced relationship to each other, and means rigidly connecting said rear wire guide chutes with each other;

(e) first power actuated means supporting said front wire infeed assembly and said rear wireguide assembly on said fixedly positioned rigid support frame for vertical movement between an upper position and a lower position;

(f) second power actuated means supporting said infeed subassembly on said feed chute head plate spacing means for non-linear movement relative to said feed chute head plates between an upper position in which upper ends of the individual wire guide infeed chutes are in a rearward position closer to an upper portion of a bale than lower ends of the individual wire guide infeed chutes; an intermediate position in which the upper and lower ends of said wire guide infeed chutes are substantially in vertical alignment and a lower position in which the lower ends of the individual wire guide infeed chutes are positioned more rearwardly than the upper ends so as to be closer to the bale to be bound; and (g) third power actuated means for moving the rear wire guide chute subassembly between rearward and forward positions relative to said left and right rear main support plates.

2. The assembly of claim 1 wherein said guide chute head plates each include a horizontal guide chute subassembly support rail and said rear wire guide chute subassembly includes guide rollers engageable with said rear wire guide chute subassembly support rails for supporting said rear wire guide chute subassembly for said front to rear movement relative to said right and left rear guide head plates.

3. The assembly of claim 2, wherein the first, second and third power means are hydraulic cylinders.

4. The assembly of claim 2, wherein the left and right front main support plates include track means for restricting motion of the feed chute head plates relative to said left and right front main support plates to linear motion in a vertical direction; the left and right rear main support plates include track means for restricting motion of the guide chute head plates relative to said left and right rear main support plates to linear motion in a vertical direction; the feed chute head plates each include a pair of arcuate cam track means for restricting motion of said infeed sub-assembly relative to said feed chute head plates to simultaneous translation and rotation; and the guide chute head plates each include track means for restricting motion of said rear wire guide chute sub-assembly relative to said guide chute head plates to linear motion in a horizontal direction.

5. The assembly of claim 1, wherein a plurality of wire guide infeed chutes are formed from pairs of adjacent plates of the plurality of parallel, chute side plates that are included in said infeed sub-assembly.

6. The assembly of claim 5, further including a plurality of drive wheels, a common drive shaft, and a motor; each of said wire guide infeed chutes having one of said drive wheels mounted between said adjacent plates; said drive wheels being operatively connected to said common drive shaft; said common drive shaft being operatively connected to said motor; and said common drive shaft being rotatably mounted to said infeed sub-assembly and a plurality of idler rollers; each of said wireguide infeed chutes having mounted thereon a pair of said idler rollers and actuating means for moving said idler rollers against said drive wheel of said wire guide infeed chute associated with said idler rollers.

7. The assembly of claim 6, further including a wire gripping means provided in each of said wire guide infeed chutes for holding wires against movement therein.

8. A method of operating a wire-tying device to position a wire tie about a bale, the wire tying device comprising (a) a plurality of wire ties with a loop at each end of each wire tie;
(b) a top platen and a bottom platen;
(c) a front assembly and a rear assembly, each having a left side, a right side, a top and a bottom;
(d) connecting means for connecting the front assembly to the rear assembly;
(e) a pair of feed chute head plates guided within the front assembly and a pair of guide chute head plates guided within the rear assembly;
(f) an infeed chute sub-assembly guided between the feed chute head plates and a guide chute sub-assembly guided between the guide chute head plates;
(g) a plurality of infeed chutes within said feed chute sub-assembly, each infeed chute having a drive wheel and drive means for rotating said drive wheel, gripping means for holding a wire tie, alignment means for preventing the wire tie from twisting when it is loaded into the front assembly, a pair of idler rollers and actuating means for moving said idler rollers against said wire tie and said drive wheel so that rotation of said drive wheel effects movement of the wire tie;
(h) power means for generating motion of the feed chute sub-assembly that is simultaneously translational and rotational;
(i) power means for generating motion of the guide chute sub-assembly that is translational;
(j) power means for generating motion of the feed chute head plates that is translational; and
(k) power means for generating motion of the guide chute head plates that is translational;

the method comprising the steps of:

(1) loading said wire ties into the front assembly;
(2) placing an end loop of each wire tie over the alignment means in each infeed chute;
(3) moving the idler rollers toward the drive wheel with a portion of the wire tie trapped in between the idler rollers and the drive wheel to permit translation of the wire tie in said infeed chute;
(4) moving the feed chute head plates and the guide chute head plates a predetermined amount;
(5) moving the feed chute sub-assembly a predetermined amount;
(6) moving the guide chute sub-assembly a predetermined amount;
(7) rotating said drive wheels in a forward direction for a predetermined amount, thereby advancing said wires into a desired position encircling compressed material to be baled;
(8) moving the guide chute sub-assembly a predetermined amount, first in one direction, and then in the opposite direction;
(9) activating the gripping means;
(10) moving the feed chute sub-assembly a predetermined amount, thereby taking slack out of each wire tie;
(11) deactivating the gripping means;
(12) rotating said drive wheels in a reverse direction for a predetermined amount, thereby partially interlocking one looped end with the opposite looped end of each wire tie;
(13) activating the gripping means; and
(14) moving the feed chute sub-assembly a predetermined amount, thereby further interlocking in an untightened manner one looped end with the opposite looped end of each wire tie so that subsequent release of pressure on the baled material will tension the wire tie and effect a tensioning of the wire tie and a tightening of the looped ends into a tight permanent bond.

* * * * *